United States Patent [19]

Goar et al.

[11] Patent Number: 4,643,093

[45] Date of Patent: Feb. 17, 1987

[54] DOUBLE-CREASED LITHOPLATE AND METHOD OF MOUNTING ON A WEB PRESS

[75] Inventors: Richard T. Goar; John H. Tholen, both of St. Paul, Minn.

[73] Assignee: Minnesota Mining and Manufacturing Company, St. Paul, Minn.

[21] Appl. No.: 707,047

[22] Filed: Mar. 1, 1985

[51] Int. Cl.[4] ..... B41F 27/12

[52] U.S. Cl. ..... 101/401.1; 101/415.1

[58] Field of Search ..... 101/415.1, 453, 378, 101/382 R, 401.1, 395, 467

[56] References Cited

U.S. PATENT DOCUMENTS

| | | | |
|---|---|---|---|
| 2,375,603 | 5/1945 | Willard | 101/415.1 |
| 2,405,749 | 8/1946 | Kern | 101/395 |
| 2,645,494 | 7/1953 | Keller | 101/415.1 |
| 2,937,593 | 5/1960 | Ritzerfeld | 101/415.1 |
| 2,963,969 | 12/1960 | Sauberlich | 101/415.1 |
| 2,970,540 | 2/1961 | Wirth | 101/415.1 |
| 3,026,848 | 12/1971 | Tafel | 101/415.1 |
| 3,112,698 | 12/1963 | Lake | 101/415.1 |
| 3,217,644 | 11/1965 | Schmidt | 101/415.1 |
| 3,260,200 | 7/1966 | Grunig | 101/415.1 |
| 3,347,162 | 10/1967 | Braznell et al. | 101/415.1 X |
| 3,358,598 | 12/1967 | Middleton | 101/401.1 |
| 3,603,255 | 9/1971 | Horner | 101/415.1 |
| 4,092,925 | 6/1978 | Fromson | 101/415.1 |
| 4,204,865 | 5/1980 | Kuehnle | 101/453 |
| 4,330,798 | 5/1982 | Heyer et al. | 101/415.1 |
| 4,403,549 | 9/1983 | Matuschke | 101/415.1 |
| 4,452,143 | 6/1984 | Heiwemann | 101/415.1 X |

FOREIGN PATENT DOCUMENTS

| | | | |
|---|---|---|---|
| 667371 | 1/1966 | Belgium | 101/415.1 |
| 100185 | 2/1984 | European Pat. Off. | 101/378 |
| 388029 | 1/1924 | Fed. Rep. of Germany | 101/415.1 |
| 649279 | 8/1937 | Fed. Rep. of Germany | 101/415.1 |
| 1071723 | 12/1959 | Fed. Rep. of Germany | 101/401.1 |
| 1274590 | 8/1968 | Fed. Rep. of Germany | 101/415.1 |
| 2103711 | 8/1972 | Fed. Rep. of Germany | 101/415.1 |
| 2126941 | 11/1972 | Fed. Rep. of Germany | 101/415.1 |
| 197808 | 8/1978 | Fed. Rep. of Germany | 101/415.1 |
| 1367860 | 12/1964 | France | 101/415.1 |
| 608428 | 1/1979 | Switzerland | 101/415.1 |
| 526837 | 9/1940 | United Kingdom | 101/415.1 |
| 807021 | 1/1959 | United Kingdom | 101/415.1 |

*Primary Examiner*—E. H. Eickholt

*Attorney, Agent, or Firm*—Donald M. Sell; James A. Smith; John C. Barnes

[57] ABSTRACT

To mount a lithoplate onto a plate cylinder of a conventional web press, the lithoplate is double crimped, a stiffener is fitted snugly between the two crimps, and the stiffener and crimped portion of the lithoplate are inserted into a longitudinal channel in a plate cylinder. The invention permits for the first time precision mounting of a lithoplate which has a stretchable base such as a polyester base. A stretchable lithoplate preferably is mounted over underpacking with which it has a high effective coefficient of friction.

8 Claims, 11 Drawing Figures

DOUBLE-CREASED LITHOPLATE AND METHOD OF MOUNTING ON A WEB PRESS

BACKGROUND OF THE INVENTION

1. Field of the Invention

The invention concerns a novel method of mounting a lithoplate to the plate cylinder of a web press, many of which have plate cylinders with a reel bar lockup design, as do those manufactured by Harris Graphics, American Type Founders, Geo. Hantscho Co. Inc., and Timpsons Ltd. The invention produces a lithoplate, the crimped form of which is believed to be novel.

2. Description of the Prior Art

As illustrated in FIG. 1 of the drawing, a typical web press of the prior art has a plate cylinder 10 including a reel bar 12. Before being mounted, a metal lithoplate 14 is bent so that its lead edge fits over the leading edge or "bullnose" 16 of the plate cylinder and its trailing edge fits into a slot 18 in the reel bar 12. The reel bar is then cranked clockwise (as seen in FIG. 1) until the lithoplate fits tightly against the surface of the plate cylinder. To remove the lithoplate requires counterclockwise cranking of the reel bar. A skilled operator can remove one lithoplate and mount another in about one minute.

Most lithoplates have an aluminum base which is about 0.3 mm in thickness. To the underside of the base may be adhered a paper or plastic underpacking, the thickness of which is selected to provide the desired interference between the lithoplate and the blanket cylinder, usually about about 0.1 mm. Substantial cost reductions would be realized by using camera-direct plates having a plastic (i.e., polyester) base, but they would stretch under stresses encountered during printing on commercial web presses, and it is believed that no one has demonstrated how a stretchable lithoplate could successfully be used on the plate cylinder of a web press such as that illustrated in FIG. 1. For economy, the thickness of a plastic-base lithoplate would be less than 0.3 mm, so that a greater underpacking thickness would usually be necessary.

SUMMARY OF THE INVENTION

In the method of the invention, a lithoplate can be mounted on the plate cylinder of a web press far more quickly than by known techniques. Its removal is likewise substantially faster. The novel method requires that the plate cylinder have a longitudinal channel such as that between the reel bar and the plate cylinder in a conventional web press. Briefly, the novel method comprises the steps of:

(1) twice crimping the lithoplate substantially parallel to its lead edge so that the portion of the lithoplate between the outer crimp and the lead edge of the lithoplate extends toward the main body of the lithoplate, (2) fitting a thin, elongate stiffener snugly between the two crimps thus formed in the lithoplate, (3) inserting the stiffener and crimped portion of the lithoplate snugly into the longitudinal channel of the plate cylinder, and (4) wrapping the lithoplate around and mounting it on the plate cylinder.

A typical lithoplate is formed with registration-line openings near the lead edge, and it is desirable to locate the crimps precisely with respect to said openings. When the registration-line openings are not precisely spaced from the lead edge of the lithoplate, the method can be modified by carrying out prior to step (1) the additional step of forming notches in the lead edge, the bases of which are precisely spaced from said openings, and in step (1), locating the outer crimp with respect to the bases of the notches. That locating can be done by fitting the crimping machine with precision-adjustable stops against which the notch bases rest while the outer crimp is being formed. Then the outer crimp can be pushed against the same or similar stops while the inner crimp is being formed. For economy, the notches and the registration-line openings can be formed simultaneously.

The crimping steps of the novel method provide a lithoplate which is believed to be novel. The novel lithoplate is formed with two crimps, both parallel to the lead edge, with the portion of the lithoplate between the outer crimp and the lead edge of the lithoplate extending toward the main body of the lithoplate. Preferably each crimp forms an angle of about 45°, so that said portion extends substantially orthogonally to the main body of the lithoplate.

After double-crimping the lithoplate, a low-tack repositionable adhesive may be applied to the underside of its trailing edge in order to attach the trailing edge to the plate cylinder or underpacking in conjuction with the wrapping step (4). When the lithoplate has a supple base such as an all-plastic or an all-paper base, the force against the lithoplate upon rotating it in contact with the blanket cylinder may audibly tighten the lithoplate against the underlying surface. In doing so, the low-tack repositionable adhesive at the trailing edge of the cylinder may become gradually reseated until an equilibrium is reached between the contact force and counteracting friction between the lithoplate and the underlying surface.

When the lithoplate has a stretchable base, the plate cylinder preferably has an underpacking which is immovably adhered to the plate cylinder and is selected to have the following frictional properties in contact with the undersurface of the lithoplate. During initial rotation of the plate cylinder in contact with the blanket cylinder, the friction should be low enough to permit a hand-wound lithoplate to creep into intimate contact with the underpacking in response to stresses exerted against the lithoplate, but upon achieving intimate contact, the friction should become high enough so that those stresses substantially do not stretch the lithoplate. In order to achieve that result without wrinkling the lithoplate, a low initial rate of rotation may be necessary. Gradual application of pressure between the blanket cylinder and plate cylinder may also be helpful in avoiding wrinkling.

The desired friction between the undersurface of the lithoplate and the underpacking has been realized when both the underpacking and the base of the lithoplate were biaxially-oriented polyethylene terephthalate (polyester) film having smooth, clean, uncoated contacting surfaces.

Within about 30 seconds, a skilled operator should be able to remove a double-crimped lithoplate after a printing run and then install another double-crimped lithoplate using the method of the invention.

In a web press having a reel bar lockup, the reel bar may be used to mount an underpacking. The leading and trailing edges of the underpacking then form a longitudinal groove into which the stiffener and crimped lithoplate can be snugly inserted. Except when being used to mount underpacking, the reel bar need not be used in mounting lithoplates by the novel method. Hence, the invention permits the use of a plate cylinder which can be far less expensive than one having reel bar lockup. For example, the plate cylinder can be a simple, relatively inexpensive cylinder having a narrow longitudinal channel wide enough to receive the stiffener and crimped lithoplate and, if desired, also the trailing edge of the lithoplate.

Whether or not the plate cylinder has a reel bar lockup, its leading edge or "bullnose" preferably is sharper than are the leading edges of typical plate cylinders of reel bar lockup design. This provides more exact registration of the lithoplate. A desirably sharp leading edge should be easier to achieve in a plate cylinder having only a longitudinal channel without a reel bar. The leading edge of such a plate cylinder should form an acute angle, preferably between 40 and 70 degrees.

In carrying out the novel method, the width of the stiffener preferably approximates the distance between the two crimps, and its thickness is selected to provide with the folded lithoplate a snug fit in the longitudinal channel of the plate cylinder. The length of the stiffener preferably approximates the length of the lead edge of the lithoplate. Unless the leading edge of the plate cylinder is quite sharp, the stiffener preferably has sufficient rigidity to resist bending when subjected to printing stresses while holding the edge of the lithoplate in the longitudinal channel.

The stiffener need not itself be stiff if it has a profile that hugs the leading edge of the plate cylinder while also maintaining a desirably sharp angle at the inner crimp of the lithoplate, preferably an angle sharper than are the leading edges of plate cylinders of typical web presses. A suitable stiffener may be a profile extrusion of a thermoplastic resin such as impact-resistant polystyrene or polyvinyl chloride.

DESCRIPTION OF THE PREFERRED EMBODIMENTS

Figure 1:
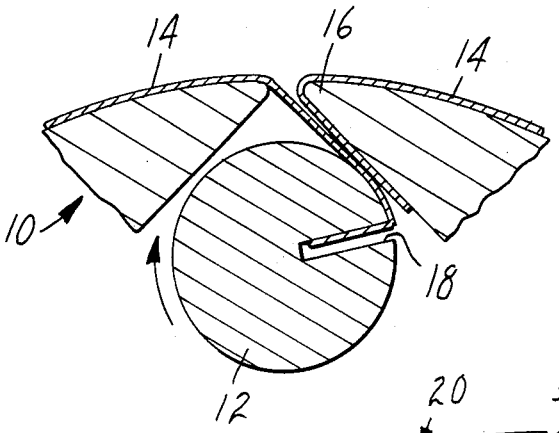
FIG. 1 PRIOR ART
FIG. 1 is a schematic cross-sectional view of the plate cylinder of a conventional web press with a metal-base lithoplate mounted in a conventional manner as practiced in the prior art.
Figure 2:
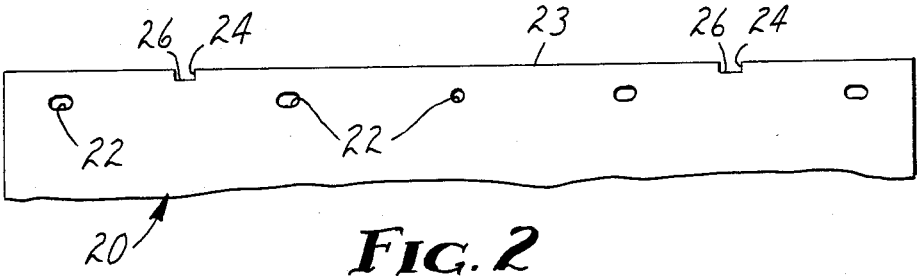
FIG. 2 is a fragmentary plan view of a plastic-base lithoplate before being crimped in the practice of the invention.

FIG. 1 having been discussed above, reference is made to FIG. 2 which shows an uncreased plastic-base lithoplate 20 which has five registration-line openings 22. In the lead edge 23 of the lithoplate have been cut two notches 24, the bases 26 of which have been located with precision with respect to the openings 22.

Figure 3:
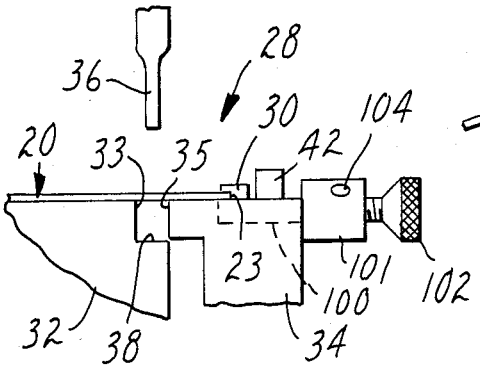
FIGS. 3–6 are fragmentary schematic side views showing the crimping of a lithoplate in the invention.
Figure 4:
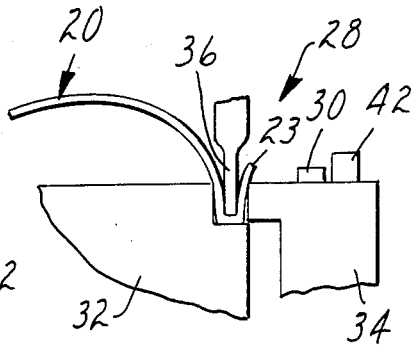
Figure 5:
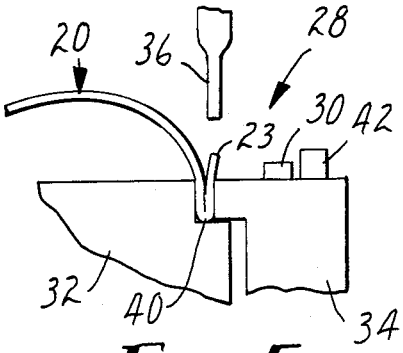
Figure 6:
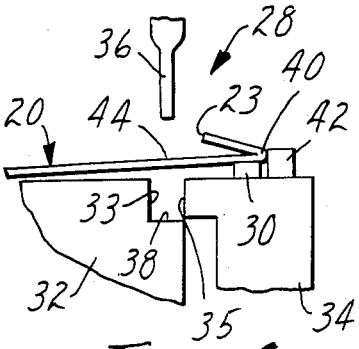
Figure 7:
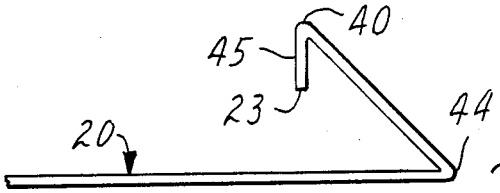
FIG. 7 shows the profile of the lithoplate of FIG. 2 after it has been crimped as shown in FIGS. 3–6.

In using the crimping machine 28 of FIGS. 3–6, the notches 24 of the uncreased lithoplate 20 are pushed squarely against a first pair of stops 30 as shown in FIG. 3, the crimper bars 32 and 34 of which have been warmed to about 65° C. As seen in FIG. 4, an elongated blade 36 moves downwardly to force the lithoplate against a seat 38 of the crimper bar 32. Immediately upon retracting the blade, the crimper bar 34 is moved to clamp the lithoplate in a vise-like action as shown in FIG. 5, thus forming a permanent outer crimp 40. The faces 33 and 35 of the crimper bars 32 and 34, respectively, are tapered so that the vise-like force is concentrated only in the region of the crimp 40. The crimper bar 34 is then retracted, and the crimp 40 (which has an angle of about 45° ) is pushed across the first stops 30 to a second stop position defined by stop means. The stop means is provided by moving the first stops or by a second pair of stops 42. At the second stop position the crimping process is repeated to form an inner crimp (also about 45°) along a line indicated at 44 in FIG. 6, thus double-crimping the lithoplate 20 as shown in FIG. 7. Since each of the crimps 40 and 44 makes approximately a 45° angle, the portion 45 of the lithoplate 20 between the outer crimp 40 and the lead edge 23 extends substantially orthogonally toward the main body of the lithoplate 20.

When the crimping machine 28 is designed for crimping lithoplates which are about 90 cm in width, the first stops 30 may be about 75 cm apart, in which event the centers of the notches 24 should have the same separation. The second stops 42 may be about 60 cm apart. Each of the four stops 30,42 should have a micrometer adjustment in the direction of movement of the crimper bar 34 or be precisely located with respect to the crimper bar.

Instead of two sets of fixed stops as illustrated, the stops 30 and 42 may be replaced by a single set of stops which are simultaneously movable between two positions, e.g., pneumatically. It also is preferred that the crimping machine include means for precisely locating those two positions. Alternatively, the first set of stops may be movable in relation to a fixed second set of stops. FIG. 3 shows an adjustment for the stops 30. Similar adjustments can be placed on the stops 42. As illustrated, each of the stops 30 are mounted on a slide bar 100 movable in an inverted T-shaped guideway in the crimper bar 34. A fixed barrel 101 has an opening to receive a projection from the bar 100 which is joined to the end of the adjusting screw 102 of the micrometer. A set screw 104 will set the position of the bar 100 once established. Such adjustments may be provided on each stop but are not shown.

Figure 8:
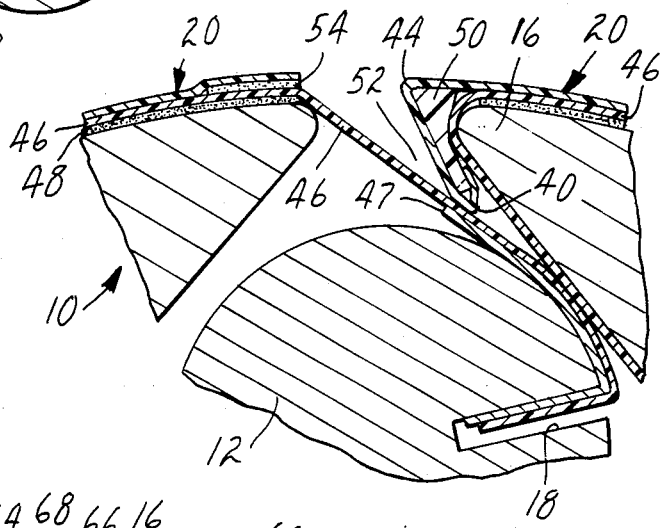
FIG. 8 shows in schematic cross section the plate cylinder of FIG. 1 to which plastic underpacking has been applied and on which has been mounted the double-crimped lithoplate shown in FIG. 7.

The mounting of the double-crimped lithoplate 20 onto the plate cylinder 10 of FIG. 1 is shown in FIG. 8. First, a plastic underpacking 46 is bent in the same manner as is a metal lithoplate in the prior art as mentioned in connection with FIG. 1. Then an L-shaped retainer 47 is adhesively bonded to the trailing edge of the underpacking to permit it to be secured by the slot 18 of the reel bar 12. After applying a layer of adhesive 48 to the underside of the underpacking 46, the underpacking is mounted onto the plate cylinder 10 using the reel bar lockup and becomes immovably adhesively bonded to the plate cylinder, as seen in FIG. 8. Before mounting the double-crimped lithoplate 20, a plastic stiffener 50 is inserted between the two crimps 40 and 44 and pressed with the crimped lithoplate into the longitudinal channel 52 between the reel bar 12 and the plate cylinder 10. The profile of the plastic stiffener 50 includes an arcuate face which hugs the leading edge 16 of the plate cylinder 10 and an opposite sharply angled edge for contacting the relatively sharp angle at the inner crimp 44 of the lithoplate 20. The remaining portion of the lithoplate is wrapped around and adhered to the plate cylinder by a thin band of low-tack repositionable adhesive 54 which had been sprayed onto the underside of the lithoplate at its trailing edge. To bring the lithoplate 20 into intimate contact with the underpacking 46, it is necessary to rotate the plate cylinder 10 in contact with its blanket cylinder (not shown), as is discussed above.

Figure 9:
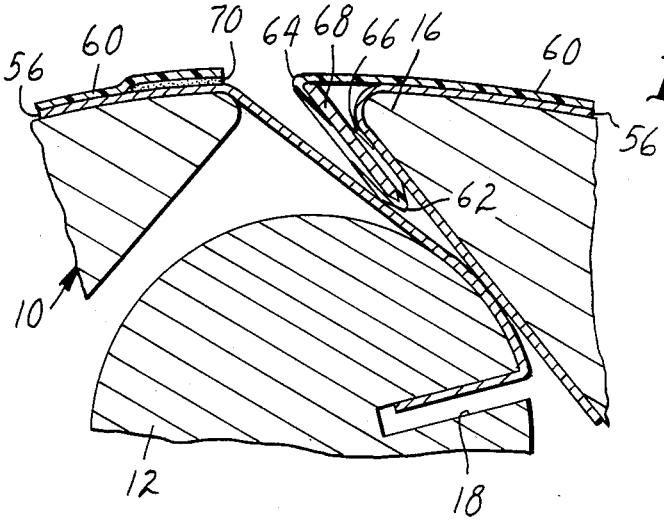
FIG. 9 shows in schematic cross section the same plate cylinder on which a double-crimped lithoplate of the invention has been mounted over metal underpacking.

In FIG. 9, the same plate cylinder 10 and reel bar 12 are used to mount a sheet-metal underpacking 56 in the manner used in FIG. 1 to mount the metal lithoplate 14. In doing so, the trailing edge of the underpacking 56 is bent and then inserted into the slot 18 of the reel bar 12 which then is cranked clockwise until the underpacking 56 fits tightly against the surface of the plate cylinder 10. Over this is mounted a double-crimped lithoplate 60, having crimps 62 and 64 (each making an angle of about 45°) formed parallel to its lead edge 66. To do so, a metal stiffener 68 is inserted between the crimps. Instead, the stiffener may be an extruded plastic strip having a profile such that it does not need to resist bending under printing forces. The stiffener 68, together with the crimped lithoplate 60, is inserted into the longitudinal channel between the leading and trailing edges of the metal underpacking 56. Before doing so, a narrow band of low-tack repositionable adhesive 70 is transferred to the underside of the lithoplate 60 in order to hold its trailing edge against the underpacking 56. After adhesively attaching the trailing edge, the plate cylinder 10 is rotated in contact with its blanket cylinder to cause the lithoplate 60 to move into intimate contact with the underpacking.

Figure 10:
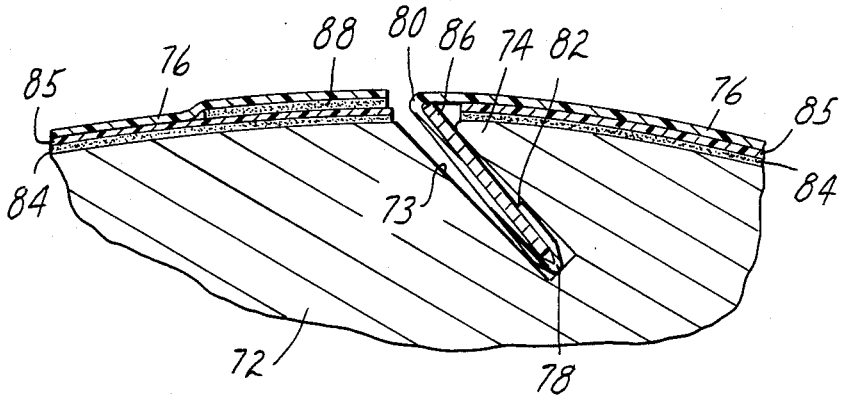
FIG. 10 shows in schematic cross section another plate cylinder on which has been mounted, in the practice of the invention, a double-crimped lithoplate of the invention.

FIG. 10 shows a plate cylinder 72 which has no reel bar lockup and is formed with a narrow longitudinal channel 73 that makes an angle of about 45° with the cylindrical face of the leading edge 74 of the plate cylinder 72. Onto the plate cylinder is mounted a lithoplate 76 which is formed with two 45° crimps 78 and 80 each substantially parallel to its lead edge 82, and thus has a profile similar to that shown in FIG. 7. Before mounting the lithoplate, a plastic underpacking 85 has been bonded to the plate cylinder by an adhesive layer 84. To mount the lithoplate 76, a stiffener 86 is fitted between the crimps 78 and 80 and inserted with the double-crimped lithoplate into the channel 73. After wrapping the lithoplate 76 around the plate cylinder 72 and adhering its trailing edge with a low-tack repositionable adhesive layer 88, it is seated against the underpacking in the manner described above.

Figure 11:
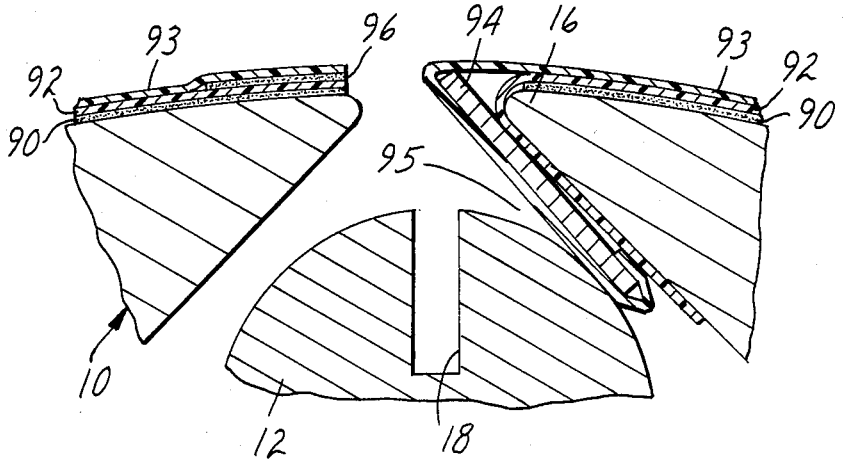
FIG. 11 shows in schematic cross section the mounting of a double-crimped lithoplate of the invention.

In FIG. 11, an adhesive layer 90 bonds a plastic underpacking 92 to the plate cylinder 10 of FIG. 1. Over this is mounted a double-crimped lithoplate 93 by means of a stiffener 94 which has been fitted between the crimps and inserted into the longitudinal channel 95 between the reel bar 12 and the leading edge 16 of the plate cylinder 10. The trailing edge of the lithoplate is adhered to the underpacking 92 by a band of low-tack repositionable adhesive 96. Except to form part of the longitudinal channel 95, no use is made of the reel bar 12 in FIG. 11.

The polyester films used as the polyester base of lithoplates employed in the examples, and used as the polyester underpacking in some of the examples, was biaxially-oriented polyethylene terephthalate film.

EXAMPLE 1

A tin-plated steel underpacking 0.20 mm thick was mounted on the plate cylinder of a Hantscho web press utilizing the reel bar lockup as illustrated in FIG. 9. A lithoplate having a polyester base (approximately 927×590×0.19 mm) was double crimped to the profile shown in FIG. 7 and mounted as follows:

1. Crimp 40 was 3.2 mm from and parallel to the lead edge and formed an angle of approximately 45°.
2. Crimp 44 was 11.4 mm from and parallel to crimp 40 and formed an angle of approximately 45°.
3. A spring-tempered (reusable) steel stiffener (approximately 927×10.2×0.5 mm) was inserted between crimps 40 and 44.

A low-tack repositionable adhesive was lightly sprayed onto the underside of the lithoplate to cover the area within about 5 cm from its trailing edge. The lithoplate was then mounted on the printing cylinder (hand tension), and its adhesive-bearing trailing edge was pressed against the steel underpacking as shown in FIG. 9. As the lithoplate was being inked up in normal fashion (i.e., slow press rotation), an adhesive tearing sound was heard as the plate "seated" itself to the printing cylinder. This sound was believed to be the adhesive layer being repositioned on the plate cylinder with each revolution as a result of "ironing out" looseness (wrinkles, etc.), misalignments, and stretching of the polyester base (approximately 1.3 mm in this instance) due to the normal forces from contact with the blanket cylinder. The blanket cylinder had a compressible blanket that produced an interference of approximately 0.09 mm, which is considered to be normal for this type of printing. In excess of 60 plastic-base lithoplates were mounted in this manner to eight plate cylinders of the press and tested up to the maximum press speed of approximately 400 rpm. Printed image registration from printing unit to printing unit was acceptable and as good as or better than registration realized with metal-base lithoplates mounted on the same press in accordance with the prior art.

EXAMPLE 2

A polyester underpacking 0.19 mm thick was adhesively bonded to the plate cylinder of an A.T.F. web press utilizing an L-shaped aluminum reinforcement (as shown in FIG. 8) which had been adhesively bonded to the trailing edge of the underpacking 46 to hold it securely within the slot 18 of the reel bar 12. A polyester-base lithoplate of the same dimensions as that of Example 1 was mounted on the plate cylinder per the description given in Example 1. Repositioning of the trailing edge of the lithoplate was again noted during the normal inking or roll up operation. A very significant difference occurred, however, in that there was no evidence that the lithoplate stretched as it did in Example 1. This may be attributable to the high effective coefficient of friction between the polyester base and the polyester underpacking. Several lithoplates mounted in this manner were tested under normal blanket and form roller pressures with satisfactory results, but without ink transfer to a paper web. The maximum press speed of about 300 rpm was achieved in the testing.

EXAMPLE 3

A polyester underpacking 0.19 mm thick was adhesively bonded to the plate cylinder of a Harris 700 web press without using the reel bar lockup mechanism, and its trailing edge was trimmed off at the trailing edge of the plate cylinder. A lithoplate having a polyester base of approximately 0.19 mm was double crimped and assembled as in Example 1 except that the two crimps were 17.1 mm apart, and the width of the spring steel stiffener was 15.9 mm. As shown in FIG. 11, the double-crimped lithoplate and stiffener were inserted into the clearance groove between the leading edge of the plate cylinder and the unused reel bar, while the trailing edge was adhered per the description given in Example 1. Repositioning of the trailing edge was noted during the normal inking or roll up operation, but no stretching of the lithoplate was observed. Ten lithoplates were mounted in this manner to four different plate cylinders (utilizing two printing units or towers) for printing at press speeds up to 370 rpm. Unit-to-unit and front-to-back registration during this test was equal to or better than that achieved with aluminum-base lithoplates mounted in the conventional manner.

We claim:

1. Method of mounting a lithoplate on the plate cylinder of a web press, which cylinder has a longitudinal channel for receiving the lead edge of the lithoplate, said method comprising the steps of:

(1) twice crimping the lithoplate along lines parallel to each other and parallel to registration-line openings near its lead edge so that the portion of the lithoplate between the outer crimp and the lead edge of the lithoplate extends toward the main body of the lithoplate, (2) fitting a thin, elongate stiffener snugly between the two crimps thus formed in the lithoplate, (3) applying adhesive to the underside of the lithoplate along its trailing edge, (4) inserting the stiffener and crimped portion of the lithoplate snugly into the longitudinal channel of the plate cylinder, and (5) wrapping the lithoplate around and attaching the trailing edge to the plate cylinder by pressing the adhesive against the plate cylinder.

2. Method as defined in claim 1 wherein the length of the stiffener approximates the length of the lead edge of the lithoplate.

3. Method of mounting a lithoplate formed with registration-line openings near its lead edge on the plate cylinder of a web press, which cylinder has a longitudinal channel for receiving the lead edge of the lithoplate, said method comprising the steps of:

(1) forming notches in the lead edge, the bases of which are precisely spaced from said openings, (2) twice crimping the lithoplate adjacent its lead edge and locating the outer crimp substantially parallel to the bases of the notches and the second crimp so that the portion of the lithoplate between the outer crimp and the lead edge of the lithoplate extends toward the main body of the lithoplate, (3) fitting a thin, elongate stiffener snugly between the two crimps thus formed in the lithoplate, (4) applying adhesive to the underside of the lithoplate along its trailing edge, (5) inserting the stiffener and crimped portion of the lithoplate snugly into the longitudinal channel of the plate cylinder, and (6) wrapping the lithoplate around and attaching the trailing edge to the plate cylinder by pressing the adhesive against the plate cylinder.

4. Method as defined in claim 3 wherein said notches and the registration-line openings in the lithoplate are formed simultaneously.

5. Method as defined in claim 4 wherein the stiffener is selected to have sufficient rigidity to resist bending when subjected to printing stresses while holding the lead edge of the lithoplate in said channel.

6. Method as defined in claim 4 wherein the stiffener has a profile including an arcuate face which hugs the leading edge of the plate cylinder and a sharp angle at the opposite face to engage the inner crimp of the lithoplate.

7. A lithoplate having a main body with a lead edge and a trailing edge and formed with two crimps, both parallel to and adjacent its lead edge, each of said two crimps forms an angle of 45°, with the portion of the lithoplate between the outer crimp and the lead edge of the lithoplate extending toward and substantially orthogonally with respect to the main body of the lithoplate.

8. A lithoplate as defined in claim 7 bearing a narrow band of low-tack repositionable pressure-sensitive adhesive on its underside along its trailing edge.

* * * * *